US006458264B1

(12) United States Patent
Muramatsu et al.

(10) Patent No.: US 6,458,264 B1
(45) Date of Patent: Oct. 1, 2002

(54) SN-CU ALLOY PLATING BATH

(75) Inventors: Yoshiaki Muramatsu; Yoshihiko Yada; Hideki Miyazaki; Kanae Tokio, all of Fujisawa (JP)

(73) Assignee: Ebara-Udylite Co., Ltd., Tokyo (JP)

( * ) Notice: Subject to any disclaimer, the term of this patent is extended or adjusted under 35 U.S.C. 154(b) by 13 days.

(21) Appl. No.: 09/679,619

(22) Filed: Oct. 5, 2000

(30) Foreign Application Priority Data

Oct. 7, 1999 (JP) ..... 11-286748

(51) Int. Cl.[7] ..... C25D 3/60
(52) U.S. Cl. ..... 205/241; 205/253; 205/254
(58) Field of Search ..... 205/241, 253, 205/254; 106/1.13, 1.18, 1.23, 1.26

(56) References Cited

U.S. PATENT DOCUMENTS 4,440,608 A * 4/1984 Opaskar et al. ..... 204/435
4,749,626 A * 6/1988 Kadija et al. ..... 428/647
5,143,544 A * 9/1992 Iantosca ..... 106/1.22
6,183,545 B1 * 2/2001 Okuhama et al. ..... 106/1.18

* cited by examiner

*Primary Examiner*—Nam Nguyen
*Assistant Examiner*—William T. Leader
(74) *Attorney, Agent, or Firm*—Oblon, Spivak, McClelland, Maier & Neustadt, P.C.

(57) ABSTRACT

An acidic Sn—Cu alloy plating bath composition comprising: (a) $Sn^{2+}$ ions and $Cu^{2+}$ ions, (b) at least one acid selected from the group consisting of alkane sulfonic acids, alkanol sulfonic acids, and sulfuric acid, and (c) a thiourea compound. The composition exhibits high current efficiency and does not cause Cu to deposit on the Sn anode, the Sn—Cu alloy plating bath is free from such problems as inadequate adhesion of the plating to substrate and covering of with copper deposit. Moreover, processing waste water from the Sn—Cu plating bath is easy because the composition does not contain a complexing agent. The Sn—Cu alloy plating bath of the present invention, therefore, can advantageously produce not only Sn—Cu alloy plating but also ternary alloy plating containing other metals in an industrial scale.

12 Claims, No Drawings

SN-CU ALLOY PLATING BATH

BACKGROUND OF THE INVENTION

1. Field of the Invention

The present invention relates to an acidic Sn—Cu alloy plating bath. More particularly, the present invention relates to an acidic Sn—Cu alloy plating bath which can prevent the Cu substitution-deposition problem which is a serious problem in large scale industrial production.

2. Description of Prior Art

Conventionally, Sn—Cu alloy plating has been applied to bronze plating for decorating purposes. In recent years, however, the Sn—Cu alloy plating is attracting attention as a plating method which can be used in place of solder plating (Sn—Pb alloy plating).

As Sn—Cu alloy plating baths, a copper cyanide-alkaline stannate bath (Japanese Patent Application Laid-open No. 96936/1977), a pyrophosphoric acid bath (Japanese Patent Applications Laid-open No. 72196/1981 and No. 272394/1986), and a copper cyanide-copper pyrophosphate bath (Japanese Patent Application Laid-open No. 60091/1982) are known. In addition, an Sn—Cu alloy plating bath using an inorganic acid in an amount sufficient to maintain 2.0 or less pH has been disclosed as an acidic bath (Japanese Patent Application Laid-open No. 177987/1982).

Of these baths, the acidic bath appears to be more advantageous than other baths in industrial application due to the excellent current efficiency. However, actually the bath has a serious problem which renders the method difficult to be applied. Specifically, a problem with the acidic Sn—Cu alloy plating bath, which is not mentioned in the Japanese Patent Application Laid-open No. 177987/1982, is that copper deposits due to substitution when the plated material is made of a metal with an electric potential lower than copper such as iron and nickel. This is caused due to the presence of free $Cu^{+2}$ ion in the acidic Sn—Cu alloy plating bath and unduly impairs plating adhesion. Copper deposits also on the anode when Sn is used as the material of the anode, rendering the anode difficult to be dissolved and interfering with the plating bath stability. Moreover, $SnO_2$ and the like cause turbidity if $Sn^{2+}$ and $Cu^{2+}$ are present at the same time.

Use of a complexing agent may be one way of stabilizing $Cu^{2+}$ to overcome this type of problems. A complexing agent, however, impairs waste water processability, thus creating another problem of making processing of waste water difficult.

The subject to be solved in the present invention is therefore to provide an acidic Sn—Cu alloy plating bath which can prevent the Cu substitution-deposition problem and turbidity due to production of $SnO_2$ without using a complexing agent.

The inventors of the present invention have conducted extensive studies to solve the above-described problem and have found that the Cu substitution-deposition problem and turbidity of the plating solution can be prevented without using a complexing agent by adding a thiourea compound to an acidic solution comprising Sn, Cu, and an acid such as analkane sulfonic acid, alkanol sulfonic acid, sulfuric acid, or the like in an amount sufficient to solve Sn and Cu.

SUMMARY OF THE INVENTION

Specifically, an object of the present invention is to provide an acidic Sn—Cu alloy plating bath composition comprising: (a) $Sn^{2+}$ ions and Cu ions, (b) at least one acid selected from the group consisting of alkane sulfonic acids, alkanol sulfonic acids, and sulfuric acid, and (c) a thiourea compound.

Another object of the present invention is to provide an acidic Sn—Cu alloy plating bath composition comprising a nonionic surfactant in addition to the above-described components (a) to (c).

Still another object of the present invention is to provide an Sn—Cu alloy plating method comprising subjecting a material to be plated to cathodic electrolysis in either of the above-mentioned acidic Sn—Cu alloy plating bath compositions.

Other objects, features and advantages of the invention will hereinafter become more readily apparent from the following description.

DETAILED DESCRIPTION OF THE INVENTION AND PREFERRED EMBODIMENT

The acidic Sn—Cu alloy plating bath composition of the present invention (hereinafter called "Sn—Cu plating bath") comprises (a) $Sn^{2+}$ ions and $Cu^{2+}$ ions, (b) at least one acid selected from the group consisting of alkane sulfonic acids, alkanol sulfonic acids, and sulfuric acid, and (c) a thiourea compound.

Of these components, the $Sn^{2+}$ ions and $Cu^{2+}$ ions which are the component (a) are made available at the initial time of preparation by providing oxides of these ions, such as tin (II) oxide and copper (II) oxide, and adding an anion of the component (b) to the oxides, or by dissolving the anion salt of the component (b) of $Sn^{2+}$ion or $Cu^{2+}$ion, for example, tin methane sulfonate, copper methane sulfonate, tin ethane sulfonate, copper ethane sulfonate, tin isopropanol sulfonate, copper isopropanol sulfonate, tin sulfate, or copper sulfate. During plating, the $Sn^{2+}$ ions and $Cu^{2+}$ ions are made available by the anode or the anion salt of $Sn^{2+}$ion or $Cu^{2+}$ion.

On the other hand, the acid selected from the group consisting of alkane sulfonic acids, alkanol sulfonic acids, and sulfuric acid, which is the component (b), is supplied as a free acid or as a salt of $Sn^{2+}$ion or $Cu^{2+}$ion which is the component (a).

As the thiourea compound which is the component (c), thiourea, diethyl thiourea, phenyl thiourea, allyl thiourea, acetyl thiourea, diphenyl thiourea, benzoyl thiourea, and the like can be given.

The respective amount of $Sn^{2+}$ ions and $Cu^{2+}$ ions contained in the Sn—Cu plating bath of the present invention as component (a) is preferably 0.5–20 wt % and 0.01–2 wt %, and particularly preferably 1–5 wt % and 0.02–0.2 wt %. The ratio of $Sn^{2+}$ ions and $Cu^{2+}$ ions may be varied according to the composition of the target alloy plating to be deposited. For instance, when an eutectic alloy plating consisting of about 99.3% of Sn and about 0.7% of Cu is desired, the ratio of $Sn^{2+}$ ions and $Cu^{2+}$ ions may be about 50:1 to 100:1.

The amount of alkane sulfonic acids, alkanol sulfonic acids, and sulfuric acid contained in the Sn—Cu plating bath as component (b) may be about 5–300 g/l, and preferably about 50–150 g/l.

The amount of a thiourea compound contained in the Sn—Cu plating bath as component (c) may be about 0.1–20 g/l, and preferably about 1–10 g/l. Because the thiourea compound has an action of interfering with deposition of Cu, the amount to be added is preferably increased when the Sn—Cu plating bath contains a large amount of $Cu^{2+}$ ions.

In addition to the above-described essential components, a nonionic surfactant may be added to the Sn—Cu plating bath as component (d). As specific examples of the component (d), surfactants containing any one of the compounds shown by the following formulas (1) to (4) as a major component can be given.

[Chemical Formula 1]

(1)

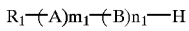

(2)

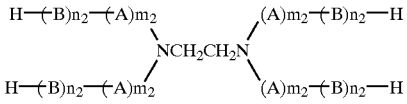

(3)

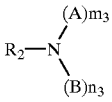

(4)

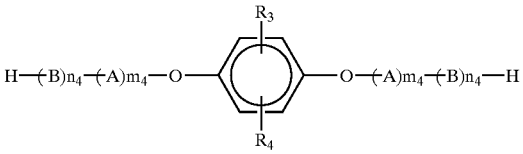

wherein $R_1$ represents a hydrogen atom or a residue obtained by excluding a hydrogen atom from the hydroxyl group of an aliphatic alcohol having 8–22 carbon atoms, phenol substituted with an alkyl group having 1–25 carbon atoms, β-naphtol substituted with an alkyl group having 1–25 carbon atoms, alkoxylated phosphoric acid having 1–25 carbon atoms, sorbitan estrified with a fatty acid having 8–22 carbon atoms, or styrenated phenol in which the hydrogen atom may be substituted by an alkyl group having 1–4 carbon atoms or a phenyl group, $R_2$ represents an alkyl group having 8–18 carbon atoms, $R_3$ and $R_4$ individually represent a hydrogen atom or an alkyl group having 1–5 carbon atoms, A represents —$CH_2CH_2O$—, B represents —$CH_2CH(CH_3)O$—, $m_1$ and $n_1$ are individually an integer from 0 to 30, $m_2$, $n_2$, $m_3$, and $n_3$ are individually an integer from 0 to 40, and $m_4$ and $n_4$ are individually an integer from 0 to 20, provided that $m_1$ and $n_1$, $m_2$ and $n_2$, $m_3$ and $n_3$, or $m_4$ and $n_4$ are not simultaneously zero, $m_1$ to $m_4$ and $n_1$ to $n_4$ individually indicate the total number of substituents, and positions of A and B are not limited.

All these nonionic surfactants can be prepared by adding prescribed mols of ethylene oxide and/or propylene oxide to a corresponding aliphatic alcohol, substituted phenol, alkyl substituted β-naphtol, alkoxyl phosphoric acid, estrified sorbitan, styrenated phenol, ethylenediamine, monoalkyl amine, or diphenol which may be substituted by an alkyl. In addition, these nonionic surfactants are readily available as commercial products.

Given as examples of commercially available products are Plurafac LF401 (manufactured by BASF) having the chemical structure of the formula (1), Tetronic TR-702 (manufactured by Asahi Denka Kogyo Co., Ltd.) having the chemical structure of the formula (2), Naimeen L-207 (manufactured by Nippon Oil and Fats Co., Ltd.) having the chemical structure of the formula (3), Liponox NC-100 (Lion Co., Ltd.) having the chemical structure of the formula (4), and the like. The nonionic surfactant is generally added to the Sn—Cu plating bath to make a concentration of about 0.5–30 g/l.

Metal ions other than Sn and Cu may further be added to the Sn—Cu plating bath composition of the present invention, in which case the plating bath composition is a ternary alloy or more metal-containing alloy composition containing tin and copper as major components. $Bi^{3+}$, $Ag^{+}$, and the like can be given as examples of metal ions which can be added.

To perform Sn—Cu alloy plating using the Sn—Cu plating bath of the present invention, the object to be plated is immersed in the plating bath prepared as mentioned above and electrolysis is carried out using that object as a cathode. Specifically, electrolysis is carried out using metallic tin, tin-copper alloy, or the like as an anode, stirring by cathode rock, jet or the like under the conditions of a temperature of about 10–50° C. and a current density of about 0.1–100 $A/dm^2$.

Because Cu substitution-deposition is suppressed due to the action of a thiourea compound (component (c)) in the Sn—Cu plating bath of the present invention, Sn—Cu alloy can be plated onto the material made of a metal with an electric potential lower than copper such as iron and nickel without impairing plating adhesion.

Moreover, since the thiourea compound suppresses the action of $Cu^{2+}$, $Sn^{2+}$ is difficult to be oxidized so that turbidity due to $SnO_2$ can be prevented.

Other objects, features and advantages of the invention will hereinafter become more readily apparent from the following description.

DETAILED DESCRIPTION OF THE INVENTION AND PREFERRED EMBODIMENT

The present invention will be described in more detail by way of Test Examples and Examples which should not be construed as limiting the present invention.

Test Example 1

<Measurement of Deposited Cu onto Anode>

The following two acidic Sn—Cu alloy plating bath compositions were prepared. A metallic Sn anode was immersed in each of the compositions. After 24 hours, the anodes were removed from the compositions to visually inspect the surface conditions. In addition, Cu concentrations before immersing the anode and after removing the anode were analyzed by the atomic absorption spectroscopy. Results are shown in Table 1.

<Acidic Sn—Cu Alloy Plating Bath Composition>

Composition (1): Base solution ($Sn^{2+}$: 20 g/l, $Cu^{2+}$: 1 g/l, methanesulfonic acid: 150 g/l)

Composition (2): Base solution+thiourea 6 g/l

<Results>

TABLE 1

| Alloy plating bath composition | External appearance of anode | Cu Concentration (g/l) Before immersion | Cu Concentration (g/l) After immersion | Rate of decrease (%) |
|---|---|---|---|---|
| Composition (1) | Turned charcoal | 1.12 | 0.37 | 67.0 |
| Composition (2) | Turned yellow | 1.13 | 1.10 | 2.7 |

As clear from Table 1, Cu was seen depositing onto the anode in the composition (1). The analysis using the atomic absorption spectroscopy revealed a significant decrease in the concentration of Cu in the composition (1), confirming that Cu deposited onto the anode. In contrast, Cu did not deposit onto the anode in the composition (2).

EXAMPLE 1

<Acidic Sn—Cu Alloy Plating Bath Composition (1)>

An acidic Sn—Cu alloy plating bath of the following composition was prepared. The plating bath was used under the following conditions to obtain an Sn—Cu alloy plated layer with a thickness of about 8 μm. The composition of the alloy plated layer was examined to confirm 96% Sn and 4% Cu.

| <Plating bath composition> | |
|---|---|
| Tin (II) oxide | 20 g/l |
| Copper (II) oxide | 2 g/l |
| Methanesulfonic acid | 180 g/l |
| Thiourea | 6 g/l |
| 12 mol ethylene oxide adduct to nonylphenol ethoxylate | 5 g/l |

<Plating Conditions>

Anode: Metallic Sn

Stirring: Cathode rock

Current density: 10 A/dm$^2$

Plating time: 2 minutes

EXAMPLE 2

<Acidic Sn—Cu Alloy Plating Bath Composition (2)>

An acidic Sn—Cu alloy plating bath of the following composition was prepared. The plating bath was used under the following conditions to obtain an Sn—Cu alloy plated layer with a thickness of about 8 μm. The composition of the alloy plated layer was examined to confirm 98% Sn and 2% Cu.

| <Plating bath composition> | |
|---|---|
| Tin (II) oxide | 20 g/l |
| Copper (II) oxide | 1 g/l |
| Isopropanolsulfonic acid | 200 g/l |
| Allylthiourea | 3 g/l |
| Diethylthiourea | 3 g/l |
| 7 mol ethylene oxide adduct to laurylamine | 6 g/l |

<Plating Conditions>

Anode: Metallic Sn

Stirring: Cathode rock

Current density: 10 A/dm$^2$

Plating time: 2 minutes

EXAMPLE 3

<Acidic Sn—Cu Alloy Plating Bath Composition (3)>

An acidic Sn—Cu alloy plating bath of the following composition was prepared. The plating bath was used under the following conditions to obtain an Sn—Cu alloy plated layer with a thickness of about 5 μm. The composition of the alloy plated layer was examined to confirm 98% Sn and 2% Cu.

| <Plating bath composition> | |
|---|---|
| Tin (II) sulfate | 30 g/l |
| Copper (II) sulfate | 2 g/l |

-continued

| <Plating bath composition> | |
|---|---|
| Sulfuric acid | 120 g/l |
| Thiourea | 5 g/l |
| 8 mol ethylene oxide adduct to β-naphtol | 8 g/l |

<Plating Conditions>

Anode: Metallic Sn

Stirring: Cathode rock

Current density: 2 A/dm$^2$

Plating time: 5 minutes

EXAMPLE 4

<Acidic Sn—Cu Alloy Plating Bath Composition (4)>

An acidic Sn—Cu alloy plating bath of the following composition was prepared. The plating bath was used under the following conditions to obtain an Sn—Cu alloy plated layer with a thickness of about 10 μm. The composition of the alloy plated layer was examined to confirm 99% Sn and 1% Cu.

| <Plating bath composition> | |
|---|---|
| Tin (II) oxide | 30 g/l |
| Copper (II) oxide | 0.5 g/l |
| Methanesulfonic acid | 200 g/l |
| Acetylthiourea | 6 g/l |
| 10 mol ethylene oxide adduct to octylphenol ethoxylate | 8 g/l |
| Catechol | 1 g/l |

<Plating Conditions>

Anode: Metallic Sn

Stirring: Cathode rock

Current density: 15 A/dm$^2$

Plating time: 2 minutes

EXAMPLE 5

<Acidic Sn—Cu Alloy Plating Bath Composition>

An acidic Sn—Cu alloy plating bath of the following composition was prepared. The plating bath was used under the following conditions to obtain an Sn—Cu alloy plated layer with a thickness of about 8 μm. The composition of the alloy plated layer was examined to confirm 99% Sn and 1% Cu.

| <Plating bath composition> | |
|---|---|
| Tin (II) oxide | 80 g/l |
| Copper (II) oxide | 2 g/l |
| Methanesulfonic acid | 200 g/l |
| Diethylthiourea | 8 g/l |
| 12 mol ethylene oxide adduct to nonylphenol ethoxylate | 10 g/l |

<Plating Conditions>

Anode: Metallic Sn

Stirring: Jet

Current density: 50 A/dm$^2$

Plating time: 20 seconds

EXAMPLE 6

<Acidic Sn—Cu-Bi Alloy Plating Bath Composition>

An acidic Sn—Cu—Bi alloy plating bath of the following composition was prepared. The plating bath was used under the following conditions to obtain an Sn—Cu-Bi alloy plated layer with a thickness of about 10 $\mu$m. The composition of the alloy plated layer was examined to confirm 97% Sn, 1% Cu, and 2% Bi.

| <Plating bath composition> | |
|---|---|
| Tin (II) oxide | 30 g/l |
| Copper (II) oxide | 0.5 g/l |
| Bismuth (III) oxide | 1 g/l |
| Methanesulfonic acid | 200 g/l |
| Thiourea | 4 g/l |
| Phenylthiourea | 2 g/l |
| 12 mol ethylene oxide adduct to nonylphenol ethoxylate | 8 g/l |

<Plating conditions>

Anode: Metallic Sn

Stirring: Cathode rock

Current density: 5 A/dm$^2$

Plating time: 4 minutes

The Sn—Cu alloy plating bath of the present invention does not cause Cu substitution-deposition in spite of its acidic properties. The Sn—Cu alloy plating bath composition exhibits high current efficiency due to its acidic properties. In addition, since the composition does not cause the Cu substitution-deposition, the Sn—Cu alloy plating bath is free from such problems as inadequate adhesion of the plating to substrate and covering of Sn anode with copper deposit. Moreover, processing waste water from the Sn—Cuplating bath is easy because the composition does not contain a complexing agent.

The Sn—Cu alloy plating bath of the present invention, therefore, can advantageously produce not only Sn—Cu alloy plating but also ternary alloy plating containing other metals in an industrial scale.

Obviously, numerous modifications and variations of the present invention are possible in light of the above teachings. It is therefore to be understood that, within the scope of the appended claims, the invention may be practiced otherwise than as specifically described herein.

What is claimed is:

1. An acidic Sn—Cu alloy plating bath composition comprising:

(a) $Sn^{2+}$ ions and $Cu^{2+}$ ions in a weight ratio of 10:1–100:1;

(b) at least one acid selected from the group consisting of alkane sulfonic acids, alkanol sulfonic acids, and sulfuric acid; and (c) a thiourea compound.

2. The acidic Sn—Cu alloy plating bath composition according to claim 1, further comprising a nonionic surfactant.

3. The acidic Sn—Cu alloy plating bath composition according to claim 2, wherein the composition comprises the non-ionic surfactant in an amount of 0.5–30 g/l.

4. A method of plating an Sn—Cu alloy comprising subjecting a material to be plated to cathode electrolysis in the acidic Sn—Cu alloy plating bath composition of claim 1 or claim 2.

5. The acidic Sn—Cu alloy plating bath composition according to claim 1, wherein the $Sn^{2+}$ ions and $Cu^{2+}$ ions are in a weight ratio of 10:1–60:1.

6. The acidic Sn—Cu alloy plating bath composition according to claim 1, wherein the composition comprises the at least one acid in an amount of 5–300 g/l.

7. The acidic Sn—Cu alloy plating bath composition according to claim 1, wherein the composition comprises the at least one acid in an amount of 50–150 g/l.

8. The acidic Sn—Cu alloy plating bath composition according to claim 1, wherein the composition comprises the thiourea compound in an amount of 0.1–20 g/l.

9. The acidic Sn—Cu alloy plating bath composition according to claim 1, wherein the composition comprises the thiourea compound in an amount of 1–10 g/l.

10. The acidic Sn—Cu alloy plating bath composition according to claim 1, wherein the thiourea compound is selected from the group consisting of thiourea, diethyl thiourea, phenyl thiourea, allyl thiourea, acetyl thiourea, diphenyl thiourea and benzoyl thiourea.

11. The acidic Sn—Cu alloy plating bath composition according to claim 1, further comprising at least one of $Bi^{3+}$ ions and $Ag^{+}$ ions.

12. A method of making an acidic Sn—Cu alloy plating bath composition, the method comprising mixing $Sn^{2+}$ ions, $Cu^{2+}$ ions, a thiourea compound and at least one acid selected from the group consisting of alkane sulfonic acids, alkanol sulfonic acids, and sulfuric acid; and forming the composition of claim 1.

* * * * *